US005749500A

United States Patent [19]

Kraus et al.

[11] Patent Number: 5,749,500

[45] Date of Patent: May 12, 1998

[54] LIQUID RETRIEVING ADAPTOR FOR CYLINDRICAL CONTAINERS

[76] Inventors: Joey Kraus; Jamie Keeble, both of 2935 Severn Dr., Reno, Nev. 89503; Jimmy Moore, 3565 Ashfork Dr., Reno, Nev. 89509

[21] Appl. No.: 636,400

[22] Filed: Apr. 23, 1996

[51] Int. Cl.[6] ..... B65D 83/32

[52] U.S. Cl. ..... 222/377; 227/464.7

[58] Field of Search ..... 222/327, 328, 222/464.7, 377; 137/590; 220/571, 571.1, 625, 636; 239/342

[56] References Cited

U.S. PATENT DOCUMENTS

| | | | |
|---|---|---|---|
| 486,760 | 11/1892 | Bumann | 222/377 |
| 1,410,878 | 3/1922 | Benshoof | 222/377 |
| 1,792,356 | 2/1931 | Boiseau | 220/625 X |
| 2,105,339 | 1/1938 | Sweitzer | 222/377 X |
| 2,594,223 | 4/1952 | Santarelli | 222/377 X |
| 2,739,739 | 1/1956 | Steele | 222/464.7 X |
| 2,969,894 | 1/1961 | Reustle | 222/377 X |
| 3,360,168 | 12/1967 | Bret | 222/377 X |
| 4,694,977 | 9/1987 | Graf et al. | 222/377 X |
| 4,969,585 | 11/1990 | Hester | 222/464.7 X |
| 5,165,572 | 11/1992 | Bath | 222/327 X |
| 5,275,313 | 1/1994 | Petrillo et al. | 222/464.7 X |
| 5,333,752 | 8/1994 | Harding, Jr. | 220/571 X |
| 5,366,119 | 11/1994 | Kline | 222/464.7 X |
| 5,366,120 | 11/1994 | Tollasepp | 222/377 X |
| 5,558,252 | 9/1996 | Stapensea et al. | 222/464.7 X |

FOREIGN PATENT DOCUMENTS

| | | | |
|---|---|---|---|
| 698117 | 11/1940 | Germany | 222/464.7 |

*Primary Examiner*—Kenneth Bomberg
*Attorney, Agent, or Firm*—Terrance L. Siemens

[57] ABSTRACT

An insertable adaptor for providing a cylindrical container with a funnel and sump for collecting stored liquid centrally within the container. Preferably, the adaptor is generally in the form of a modified torus, having an inclined top wall forming a funnel, a sump for accumulating liquids collected by the funnel, an outer wall cooperating with the cylindrical wall of the container, and a bottom wall. The adapter is preferably formed monolithically, so that a hollow interior is defined by the adaptor, the hollow interior being impervious to infiltration by the stored liquid. A flexible flange projects outwardly from the adaptor, so that the adaptor resists upward displacement within the container after being forced to the bottom of the container. The sump accommodates a pickup tube of a vacuum or force operated spraying or dispensing apparatus utilizing the container as a storage receptacle for liquid to be sprayed or dispensed.

2 Claims, 4 Drawing Sheets

LIQUID RETRIEVING ADAPTOR FOR CYLINDRICAL CONTAINERS

BACKGROUND OF THE INVENTION

1. Field of the Invention

The present invention relates to an improvement for retrieving liquid from a liquid container. A device for altering configuration of the floor of the liquid container forces stored liquid to occupy a portion of the device readily accessible to a supply tube drawing liquid from the container.

2. Description of the Prior Art

Liquid containers for storing liquids which are retrieved through tubes suffer from conflicting needs. These are that most containers are essentially cylindrical, since this configuration is both relatively economical to fabricate, and also efficient with respect to effective volume. At the same time, a cylindrical container bottom presents an insoluble situation regarding ability of a tube fixed to the container to reach all liquid stored within the container. If the tube is rigid, then it will never reach a corner existing between the floor and a lateral wall of the container. If the tube is pivotally secured to the container, or flexible, it will still fail to reach the corner since the radius of swing cannot extend to the corner.

This situation is aggravated in most painting applications, wherein the tube is flexible, and has a mesh covered opening. The mesh serves as a filter for preventing entry of solid particles into the tube. This mesh must remain immersed in liquid to prevent loss of prime. Therefore, it becomes necessary that in a cylindrically bottomed container, ability to retrieve maximal liquid must be sacrificed to maintain prime.

To overcome this problem, the prior art has suggested appropriate configurations of the bottom of a container incorporating sumps and guiding baffles for directing liquids advantageously.

U.S. Pat. Nos. 4,969,585, issued to Kenneth D. Hester on Nov. 13, 1990, 5,366,119, issued to James B. Kline on Nov. 22, 1994, and 5,366,120, issued to Tonis Tollasepp on Nov. 22, 1994, all illustrate liquid dispensing containers for storing liquids which are retrieved through tubes. In each example, the respective container has a floor inclined towards a centrally located cylindrical sump. However, the prior art fails to illustrate an insertable, separate member for converting a cylindrical container to include the characteristics described above. The prior art further fails to show an insertable member having a flexible flange for negotiating a narrow neck during insertion.

None of the above inventions and patents, taken either singly or in combination, is seen to describe the instant invention as claimed.

SUMMARY OF THE INVENTION

The present invention converts conventional cylindrical containers to a configuration suited for receiving tubular conduits for retrieving liquids. This configuration includes a sump and a funnel collecting stored liquids in the sump. The sump assures that the retrieving tube will be covered to the greatest extent possible, so that dispensing systems operating under vacuum will remain operative. If air were able to enter the tube, it would be possible that prime would be lost.

This situation is addressed in the prior art by structure incorporated integrally with a liquid container. However, such integral construction presents considerable additional economic costs to fabrication of liquid containers.

Thin, watery substances are frequently dispensed from narrow necked bottles. However, other substances, such as paint and heavier lubricating oils, are thick or viscous and are typically sold in cylindrical containers. Two variations of cylindrical containers are in widespread use. One type is fully open at the top, and will be termed a pail. Another type has a restricted opening at the top, such as paint cans.

To reconfigure these containers to incorporate sump and funnel impose severe economic penalties to the container industry and consequently to its immediate and ultimate customers. Two reasons for economic penalties include additional complicated structure, and limitation of large scale production runs. It should be noted that many of the potential candidate containers are usable for storing materials which are not picked up or retrieved by vacuum, and which therefore would not benefit from integral sump and funnel. To preserve economies of scale and to further versatility, it is desired to provide a device for adapting cylindrical containers to include sump and funnel.

Therefore, there exists a need for an inexpensive yet effective device for converting or adapting existing containers to include sump and funnel.

The present invention answers this need by providing structure forming sump and funnel, but which is of uncomplicated construction. Uncomplicated construction will lead to low economic cost. The novel device can be employed only where desired, so that conventional construction of containers may continue without redesign, retooling, and prediction of actual production run demand.

The device is ring like, and is inserted into the container. Optionally, the device includes a flexible flange disposed circumferentially about the outermost diameter. This flange serves several purposes. In cans having restricted openings, it deflects during initial insertion, allowing the device to clear the restricted opening. The flange then resiliently expands or returns to its original form, thereby effectively contacting the cylindrical wall of the container into which the device is inserted.

Even in those containers lacking a restricted opening, the flange serves by locking the novel device into place. It is contemplated that the novel device will be hollow to conserve material, and will likely be considerably less dense than the liquids with which it is used. To prevent the device from floating or riding upwardly within the container, the flange acts by friction and vacuum to lock the novel device in place.

This occurs because the flange is flexible, but not infinitely so. The flange bends upwardly as the device is forced downwardly within the container. However, once in an upwardly oriented deflected position, the flange resists downward deflection. This causes frictional engagement of the cylindrical wall and development of vacuum beneath the device should the device be drawn upwardly. Therefore, the device will tend to remain as far down within the container as it has been placed by the user. The flange thus relieves the body of the device from being required to match precisely the inner diameter of the container. Accordingly, requirements for great precision leading to successful operation of the device are avoided.

The flange is flexible, and deflects as the device is forced to the bottom of the container. Liquid trapped beneath the device thus can slip past the device, and occupies the storage chamber of the container. In this manner, only a nominal amount of liquid is trapped below the device, and is lost to the user. The flange thus enables recovery of trapped liquid during insertion.

Accordingly, it is a principal object of the invention to provide an insertable device for adapting a cylindrical container to have a sump and funnel formed in the floor of the container.

It is another object of the invention to provide structure locking the device in place after insertion, whereby upward movement within the container is resisted.

It is a further object of the invention that the insertable device employ as little material in its construction as is feasible.

Still another object of the invention is to enable the insertable device to clear the restricted opening of cylindrical containers equipped with restricted openings when being inserted into the container, and to automatically expand upon clearing the restriction, whereby effective sealing contact with the cylindrical wall of the container is established after insertion.

An additional object of the invention is that the device have a flange which deflects to allow stored liquid to slip past the device into the main storage chamber of the container when the device is forced to the bottom of the container.

It is again an object of the invention to avoid requirements for great precision in matching dimensions of the novel device to those of an associated cylindrical container.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
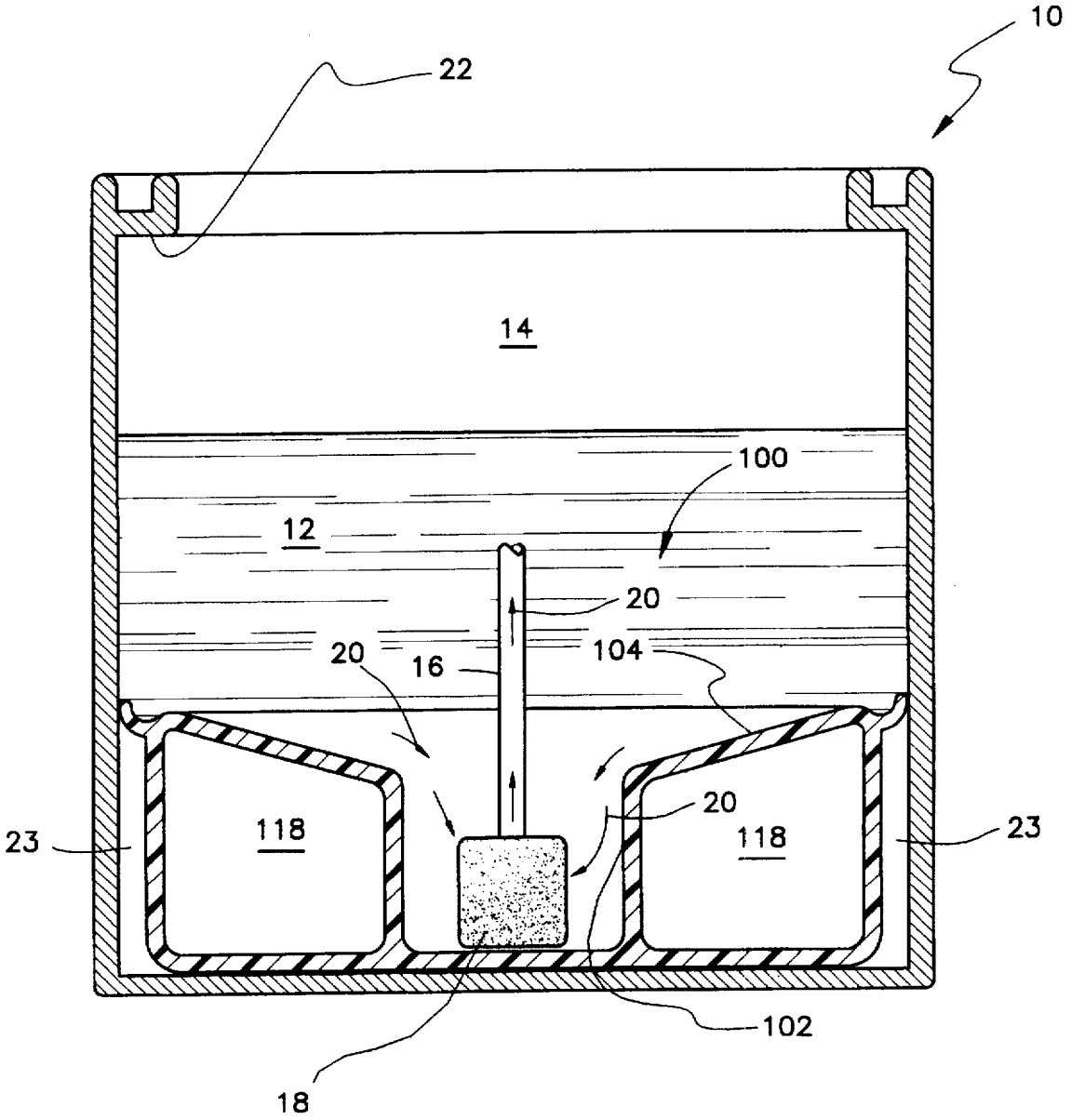
FIG. 1 is an environmental, side elevational, cross sectional view of the invention.

FIG. 1 shows a preferred embodiment of the invention wherein insertable adaptor 100 is shown inserted into a container 10. A liquid 12 partially fills container 10. Adaptor 100 has been forced to the bottom of container 10, so as to maximize a storage chamber 14 defined within container 10 above adaptor 100. A retrieval or pick-up tube 16 of a pressure responsive dispensing system (not shown in its entirety) projects into container 10. Such dispensing systems may operate by vacuum, or pressure reduced from that of ambient air. Alternatively, the dispensing system may operate by pressure increased over that of ambient air. In the latter case, container 10 will be sealed to prevent loss of pressure.

A screened terminal 18 sits at the bottom of a sump 102 formed in adaptor 100. It is important in vacuum operated systems that openings of the screen or filter of screened terminal 18 remain covered with liquid 12, or loss of prime. As liquid 12 is progressively depleted by retrieval for dispensing, remaining liquid 12 is guided by a funnel 104 formed in adaptor 100 to flow into sump 102. Arrows 20 indicate flow of liquid 12 as retrieval through tube 16 proceeds.

Figure 2:
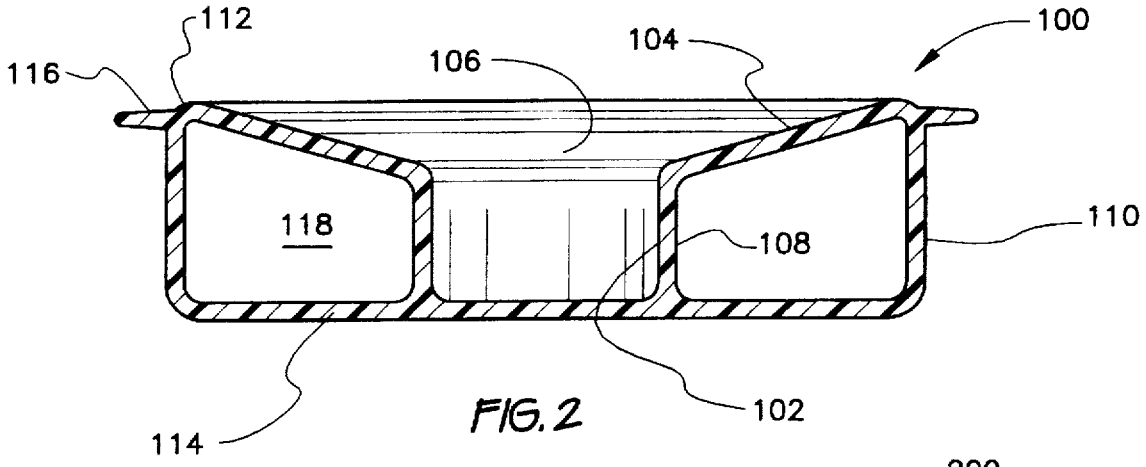
FIG. 2 is a side elevational, cross sectional view of the invention.

Turning now to FIG. 2, construction of adaptor 100 will be discussed in greater detail. Adaptor 100 has a top wall forming funnel 104. Funnel 104 has a circular top surface and a lowermost opening 106. Opening 106 discharges collected liquid directly into sump 102 disposed directly below opening 106 of funnel 104. Sump 102 has a vertically upright wall 108, which is intended to cooperate with screened terminal 18 (see FIG. 1).

In most cases, both screened terminal 18 and sump 102 will be cylindrical, although other configurations are possible. Regardless of the actual configuration of screened terminal 18, sump 102 is configured to cooperate closely therewith, although leaving a gap for liquid 12 to continue to drain into sump 102 and flow into screened terminal 18.

A lateral outer wall 110 is connected to, extends continuously along, and depends from the circular top surface or periphery of funnel 104, this point of connection being indicated at 112. The purpose of wall 110 is to brace adaptor 100 within container 10. This may occur by direct contact, or by establishing a zone 23 (see FIG. 1) of air or of liquid 12 trapped between adaptor 100 and container 10. A bottom wall 114 is connected to and extends continuously between lateral wall 110 and wall 108 of sump 102. A flexible flange 116 projects from adaptor 100. Flange 116 projects radially outwardly from adaptor 100 when not deflecting by virtue of being placed in a container. However, when placed in container 10, flange 116 deflects as shown in FIG. 1. This deflection allows adaptor 100 to pass through the opening at the top of container 10. This opening is restricted and defined by an inwardly directed flange 22. Flange 22 is typically provided in metal paint cans, among other containers, for enabling a lid to be tightly and securely press fit into the can.

In the embodiment of FIG. 1, adaptor 100 is monolithically formed such that a hollow interior 118 is permanently established, being bounded by top wall or funnel 104, lateral wall 108 of sump 102, lateral outer wall 110, and bottom wall 114. Construction of adaptor 100 is monolithic, or continuous at joints of funnel 104, and walls 108, 110, and 114, such that interior 118 is sealably enclosed. This construction prevents infiltration of liquid 12 into interior 118 between any two walls 104, 108, 110, and 114 when adaptor 100 is inserted into container 10 and immersed within liquid 12.

Figure 4:
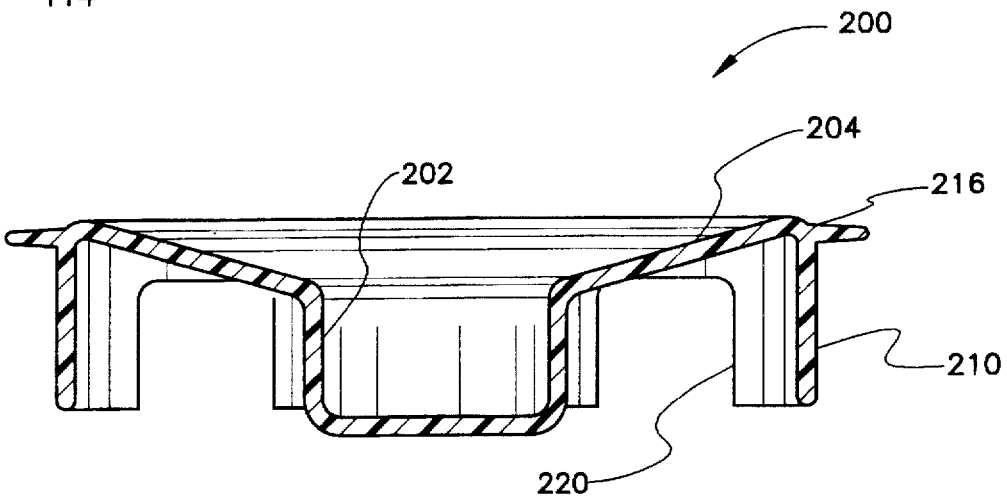
FIG. 4 is a side elevational, cross sectional view of the embodiment of FIG. 3.
Figure 3:
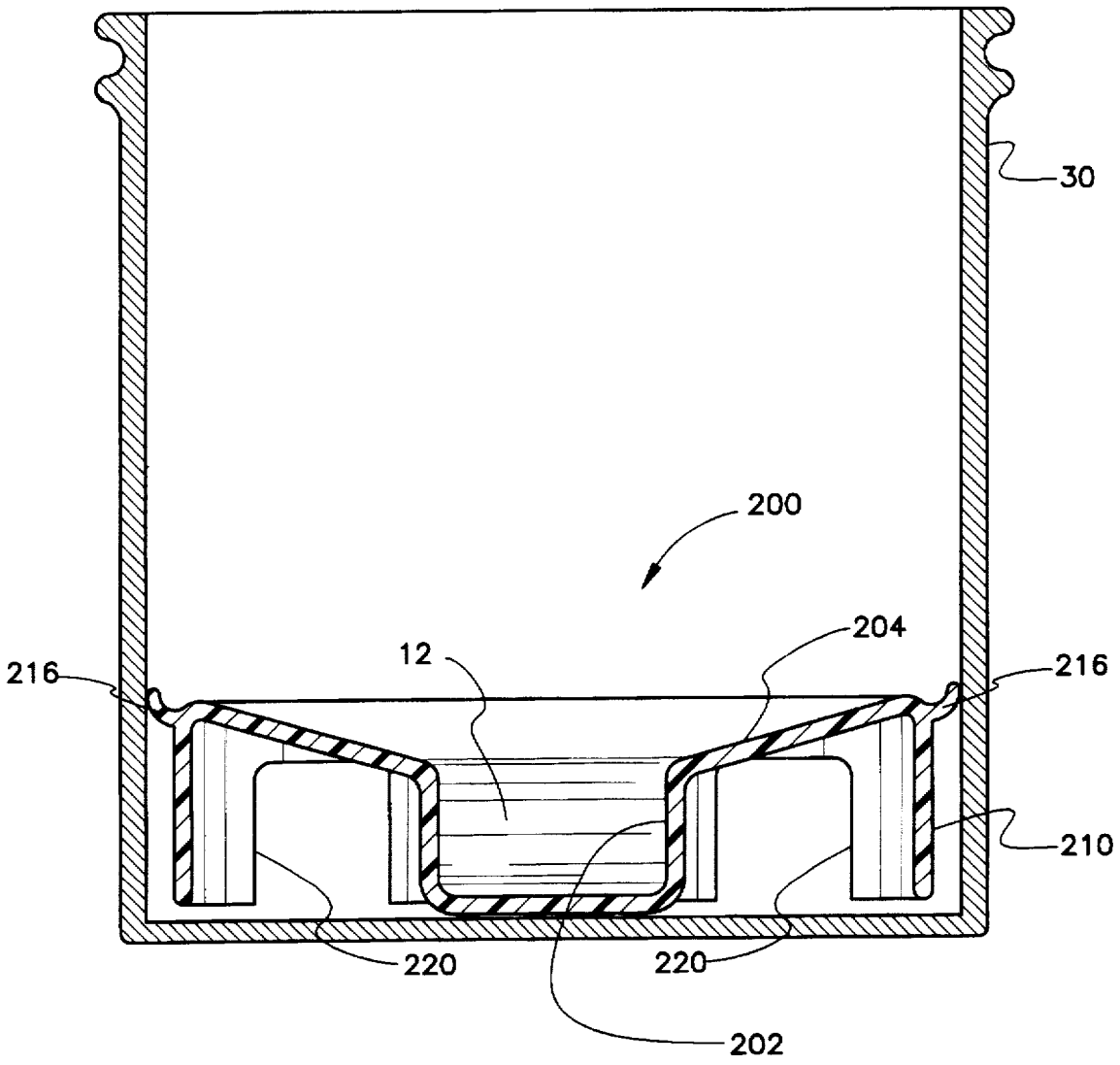
FIG. 3 is a view similar to that of FIG. 1, of an alternative embodiment of the invention.

A second embodiment of the invention is shown in FIG. 3. In this embodiment, adaptor 200 has funnel 204, sump 202, and flange 216, but departs from the construction of the first embodiment in other respects. Adaptor 200 lacks a bottom wall, and has a lateral outer wall 210 which is constructed unlike its counterpart of the first described embodiment. In the embodiment of FIG. 3, outer wall 210 is not necessarily continuous in the manner of its counterpart of FIG. 1. Since there is no bottom wall, there is little point in continuity, since there is no enclosed hollow interior as is found in the first embodiment. Therefore, wall 210 can have interruptions and openings, represented symbolically by reliefs 220. Adaptor 200 is shown isolated from its environment in FIG. 4.

The second embodiment is intended for containers 30 which lack the restricted opening formed by flange 22 of FIG. 1. Large pails are exemplary. Adaptor 200 may be inserted into a container 30 prior to filling container with liquid 12, when it is desired not to trap some liquid beneath adapter 200.

Flange 216, although still present, may be shorter than that of the first embodiment, since there is no flange 22 (see FIG. 1) which must be cleared during insertion. It will further be appreciated that in the absence of a bottom wall, and assisted by reliefs 220, adaptor 200 is more susceptible to being withdrawn from its associated container 30 than is the embodiment of FIG. 1.

The enclosed interior 118 renders adaptor 100 more rigid and resistant to collapse and deformation. This is a virtue in conserving material and in forcing adaptor 100 to the bottom of a container 10 partially filled with liquid 12, but is undesirable in other situations. Notably, when it is desired to retrieve adaptor 200 from container 30 after use, the deformability described above will expedite removal.

Figure 5:
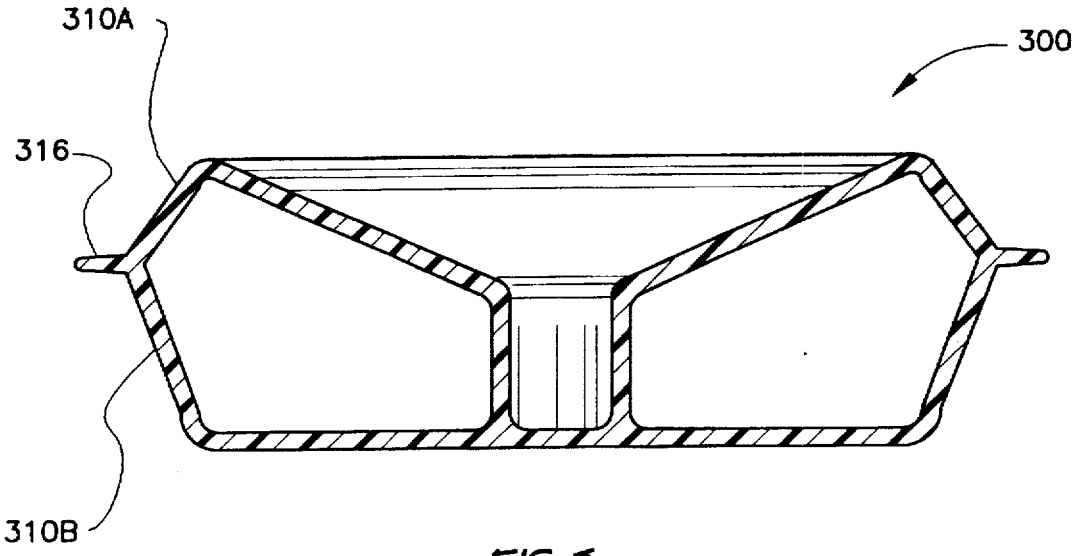
FIG. 5 is a side elevational, cross sectional view of a further embodiment of the invention.

A further embodiment is depicted in FIG. 5. In this embodiment, adaptor 300 has complementary inclined outer walls 310A and 310B. Flange 316 is formed at the juncture of walls 310A and 310B. This embodiment may be employed when close cooperation or contact with lateral walls of an associated container (not shown) is not desired or not necessary.

Figure 6:
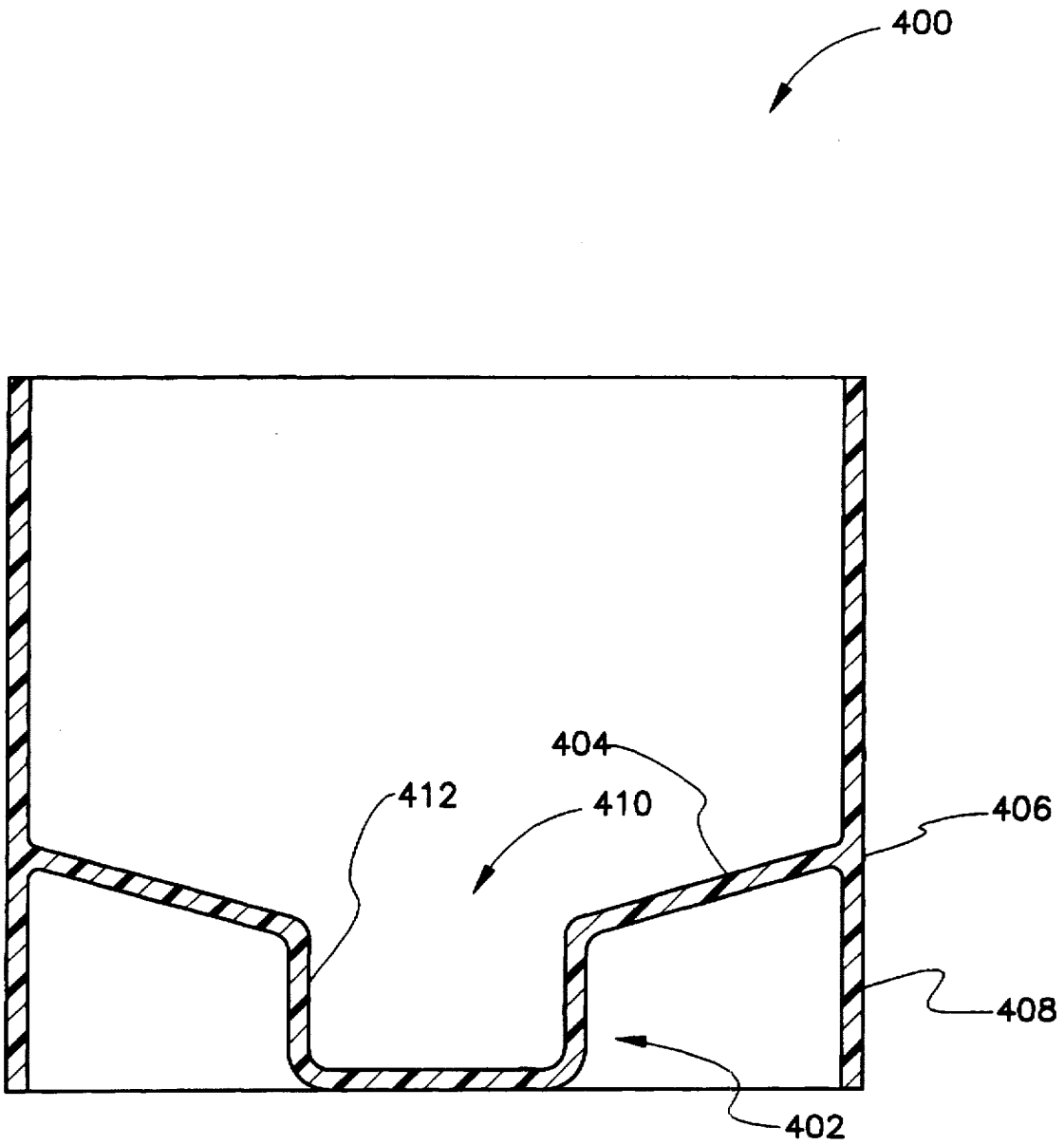
FIG. 6 is a side elevational, cross sectional view of an embodiment of the invention where the sump and the funnel are integral with the container.

Referring now to FIG. 6, it would be possible to fabricate a container 400 having sump and funnel formed integrally therewith. Container 400 has a bottom wall forming a sump 402 and a funnel 404, and a cylindrical lateral wall 406. Funnel 404 has a circular top surface cooperating with lateral wall 406 of container 400. Joint 408 existing between the bottom wall and lateral wall 406 is sealed by virtue of being continuously and monolithically formed, to prevent escape of contents from container 400.

Sump 402 is disposed below the lowermost opening 410 of funnel 404, and has a vertically upright wall 412, so that collection of liquid is concentrated at the center of container 400.

It is to be understood that the present invention is not limited to the embodiments described above, but encompasses any and all embodiments within the scope of the following claims.

I claim:

1. In combination with a cylindrical container, where said cylindrical container includes a container inner wall and a container bottom wall:

an insertable adaptor for providing a sump and funnel for retrieving liquid stored in said cylindrical container by a pressure responsive dispensing system, said adaptor having an adaptor top wall, said adaptor top wall comprising a funnel having a circular top surface and a lowermost opening;

a sump disposed below said lowermost opening, said sump having a vertically upright wall;

a lateral adaptor outer wall connected to and depending from said adaptor top wall;

an adaptor bottom wall connected to and extending continuously between said lateral adaptor outer wall and said sump; and a flexible flange projecting radially from said insertable adaptor and where said funnel, said sump, said lateral adaptor outer wall, said adaptor bottom wall, and said flexible flange are monolithically formed; whereby said insertable adaptor is dimensioned and configured such that it will fit smoothly within said cylindrical container and that said radially projecting flexible flange interacts with said cylindrical container inner wall to form a seal between said adaptor top wall and said adaptor bottom wall such that when said insertable adaptor is placed within said cylindrical container when said container contains a liquid and is moved towards said container bottom wall, liquid is displaced within said container towards said adaptor top wall and away from said adaptor bottom wall through the seal formed by said flexible flange and said container inner wall while preventing backflow and the displaced liquid is thus directed into said funnel and said sump.

2. The insertable adaptor as claimed in claim 1, further including a hollow interior, said hollow interior being formed of said adaptor top wall, said lateral adaptor outer wall, said adaptor bottom wall, and said vertical upright sump wall.

* * * * *